United States Patent [19]

Burke

[11] 4,165,550

[45] Aug. 28, 1979

[54] MOP HOLDER HAVING A UNIVERSAL HANDLE CONNECTION

[75] Inventor: Frederick A. Burke, Riverside, Conn.

[73] Assignee: Stanley Home Products, Inc., Westfield, Mass.

[21] Appl. No.: 944,323

[22] Filed: Sep. 21, 1978

[51] Int. Cl.[2] ..... A47L 13/255; B25G 3/38

[52] U.S. Cl. ..... 15/144 A; 15/145; 15/229 BP; 403/57

[58] Field of Search ..... 15/144 A, 147 R, 147 A, 15/228, 229 B, 229 BC, 229 BP, 229 BW; 403/53, 57

[56] References Cited

U.S. PATENT DOCUMENTS

| | | | |
|---|---|---|---|
| 2,736,915 | 3/1956 | Le Febvre et al. | 15/147 R |
| 2,893,033 | 7/1959 | Vosbikian et al. | 15/144 A |
| 3,162,887 | 12/1964 | Schwartz | 15/144 A X |
| 3,778,860 | 12/1973 | Thielen | 15/144 A X |

*Primary Examiner*—Daniel Blum

*Attorney, Agent, or Firm*—Ross, Ross & Flavin

[57] ABSTRACT

A mop connector comprising, a handle, a frame for releasably carrying a sleeve-like mop member, first swivel means mounted for 180° swivel movement in a vertical plane relative to the frame and releasably attached to the handle, and second swivel means mounted for 180° swivel movement about a horizontal axis pivotally coupled to the first swivel means and frame.

3 Claims, 12 Drawing Figures

MOP HOLDER HAVING A UNIVERSAL HANDLE CONNECTION

PRIOR ART STATEMENT

The following is a listing of the patents, publications or other information which the applicant believes to be the closest prior art of which he is aware:

U.S. Pat. Nos. 2,043,464; 2,192,861; 2,261,449; 2,310,011; 2,327,551; 2,497,996; 2,632,194; 2,655,413; 2,755,495; 2,755,498; 2,777,144; 2,797,968; 3,162,887; 3,362,037; 3,760,450; 3,778,860. The patents are believed to be relevant in that they disclose various structures wherein a mop handle may be moved to a plurality of angular positions relative to a frame.

None is believed to disclose the features of applicant's mop connector, wherein pairs of swivel connectors are integrated with each other and with the frame and handle as proposed herein for permitting full swivel movements in the horizontal and vertical planes.

A primary object of the invention is to provide a mop connector which is simple in its construction, inexpensive in its manufacture and reliable in its use.

Herein, a first swivel means is formed from metal stampings as identical half-parts and a second swivel means and the frame are preferably formed from plastic in a "family" mold, all for economy of manufacture and ease of mop assembly.

Figure 1:
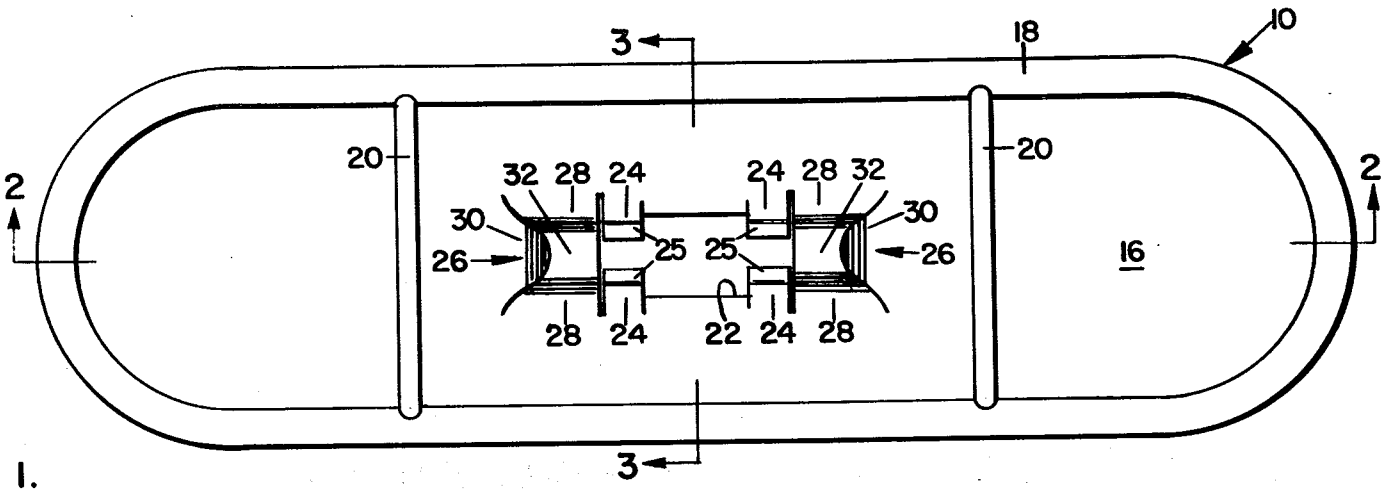
FIG. 1 is a top plan view of the frame member of the mop connector.
Figure 2:
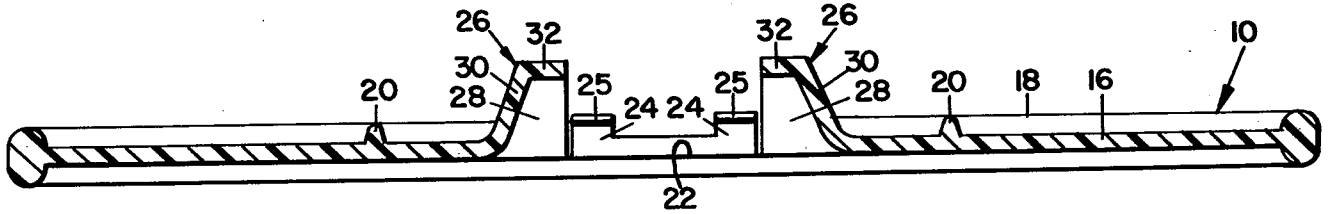
FIG. 2 is a cross-sectional view taken on line 2—2 of FIG. 1.
Figure 3:
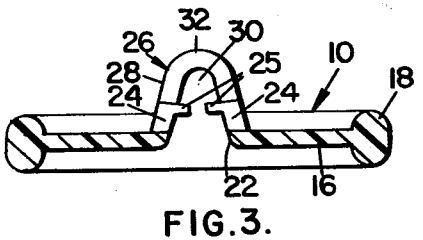
FIG. 3 is a cross-sectional view taken on line 3—3 of FIG. 1.
Figure 4:
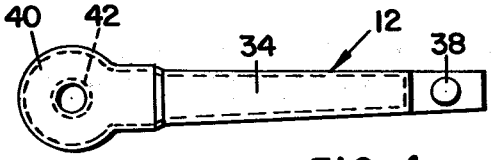
FIG. 4 is a top plan view of the first swivel means of the mop connector.
Figure 5:
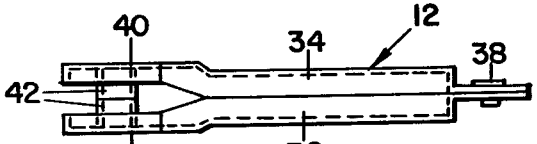
FIG. 5 is a side elevational view of the swivel means of FIG. 4.
Figure 6:
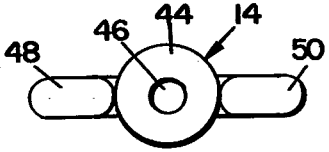
FIG. 6 is a top plan view of the second swivel means of the mop connector.
Figure 7:
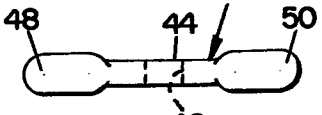
FIG. 7 is a side elevational view of the swivel means of FIG. 6.

The mop connector is comprised of a frame 10 having first and second swivel means 12 and 14, respectively, pivotally associated therewith and with each other.

Frame 10 and second swivel means 14 are preferably formed from a sturdy plastic material such as polypropylene and are molded in a "Family" mold, while the first swivel means 12 is preferably a metal stamping.

FRAME 10

Frame 10 is adapted to carry the mop body, not shown, which usually consists of fabric such as canvas, having what are called thrums attached thereto. It is common to provide a sleeve-like member of fabric for carrying the thrums and this sleeve is slipped over the frame.

The frame is generally rectangular in plan and includes a flat body portion 16 having rounded ends and a peripheral bead 18 extending therearound and a pair of spaced, parallel reinforcing ribs 20 extending transversely thereacross.

Body portion 16 is provided with a central, rectangular, longitudinally-extending opening 22 having a pair of aligned tabs or fingers 24 extending inwardly thereinto at each opposite end thereof, the tabs extending angularly upwardly from the upper surface of body portion 16 at each side of opening 22 and having an offset portion 25 disposed substantially parallel to the plane of the body portion so as to overlie opening 22, with the inner ends of the offset portions 25 being spaced from each other.

A pair of spaced, axially aligned hollow bosses 26 is provided on the central longitudinal axis of body 16, one at each end of opening 22 adjacent a pair of the tabs or fingers 24, the bosses having side walls 28 and a rear wall 30 which extend angularly upwardly from the upper surface of body portion 16 and merge into a curved upper wall 32 disposed above the plane of the offset portions 25 of tabs or fingers 24.

FIRST SWIVEL MEANS 12

First swivel means 12 is comprised of a pair of identical finger-like half parts 34 and 36 loosely and pivotally connected at one end by a pivot pin 38, each half part having an integral, hollow disc portion 40 at the end removed from pivot pin 38 and having a central pin 42 extending inwardly from the inner face of the disc portion.

The half parts may be swung relative to pivot pin 38 and relative to each other and the fit of the pivot pin and half parts is sufficiently loose as to permit the half parts to be spread apart so that the disc portions 40 thereof may be spaced from each other, for purposes to appear.

When the half parts are brought into confronting relation the pins 42 are axially aligned with each other.

SECOND SWIVEL MEANS 14

Second swivel means 14 comprises a flat central disc portion 44 having a central opening 46 therethrough and having aligned cylindrical lugs 48 and 50 extending outwardly from its opposite peripheral sides on the central horizontal axis thereof.

Disc portion 44 is of approximately the same diameter as the hollow disc portions 40 of half parts 34 and 36 of first swivel means 12, and central opening 46 is of suitable size as to receive the pins 42 of the half portions freely therethrough, as will appear.

INTEGRATION OF SECOND SWIVEL MEANS 14 WITH FRAME 10

Figure 8:
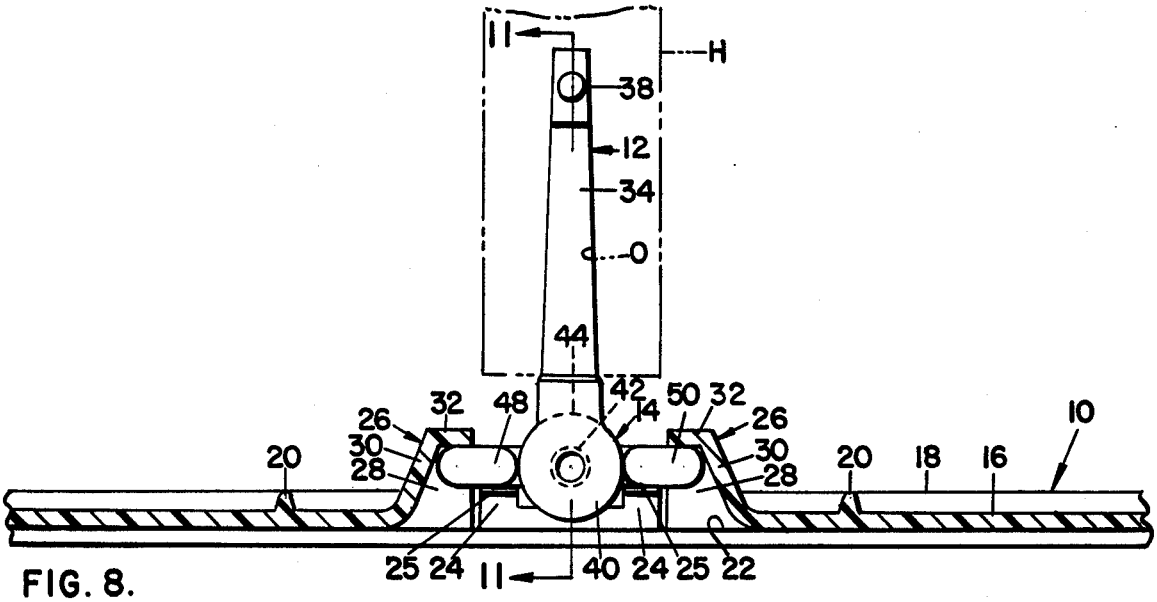
FIG. 8 is a cross-sectional view similar to FIG. 2, showing the first and second swivel means integrated with the frame member, with each other, and with a mop handle.
Figure 9:
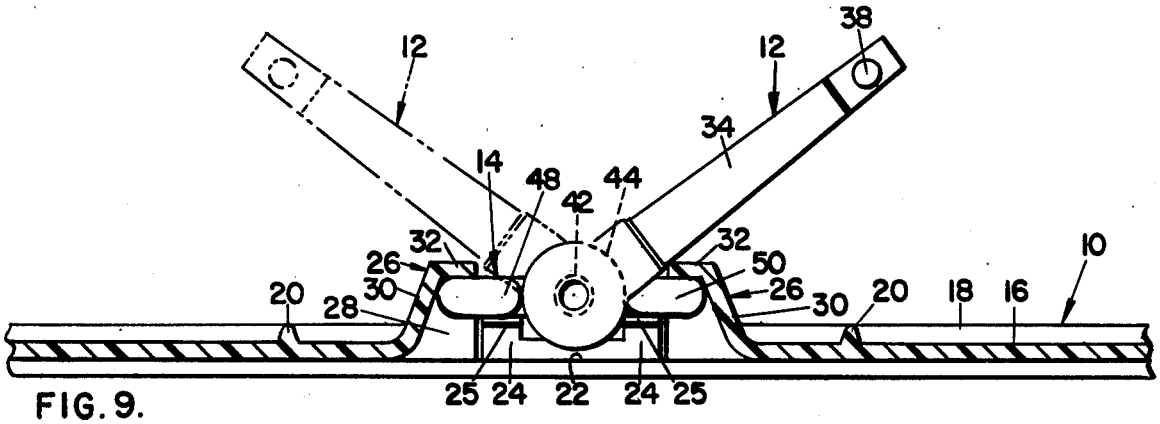
FIG. 9 is a view similar to FIG. 8, showing the first swivel means in inclined positions relative to the frame.
Figure 10:
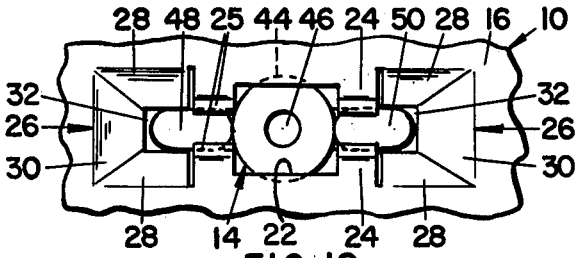
FIG. 10 is a fragmentary bottom plan view showing the relationship of the frame and second swivel means.
Figure 12:
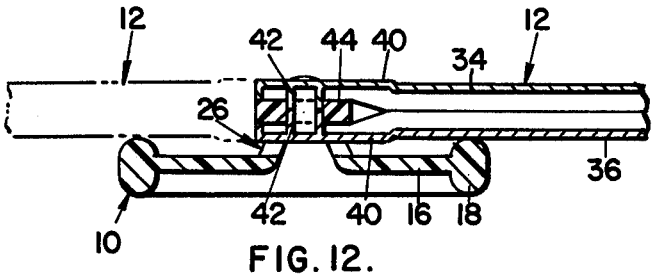
FIG. 12 is a view similar to FIG. 11 showing the first and second swivel means in horizontal positions relative to the frame.

To integrate second swivel means 14 with frame 10, the second swivel means is placed below the offset portions 25 of tabs or fingers 24 and the lugs 48 and 50 of the swivel means are forced upwardly and snapped between the offset portions which flex to permit passage of the lugs therepast and then resume their original positions so that they underlie the lug which, in turn, underlie the upper wall 32 of the bosses 26, as shown in FIGS. 8–10. The fingers 24 and offset portions 25 exert a barb-like action on the lugs 48 and 50, with any downward pressure causing the fingers to close even further, and to hold more securely.

In such position, lugs 48 and 50 serve as axles and and rotatable relative to the offset portions 25 of the tabs or fingers 24, being restrained against upward movement by the upper wall 32 of the bosses 26.

Disc portion 44 of swivel means 14 is freely rotatable in a 360° arc between the tabs or fingers 24 passing freely through opening 22 in body portion 16 of frame 10.

INTEGRATION OF FIRST SWIVEL MEANS 12 WITH SECOND SWIVEL MEANS 14

To integrate first swivel means 12 with second swivel means 14, the half parts 34 and 36 of the first swivel means are spread apart and the disc portions 40 of each half part are placed in a position wherein each cups an opposite planar face of disc portion 44 of the second swivel means. In such position, the pins 42 of the half parts pass through the opening 46 of disc portion 44.

INTEGRATION OF FIRST SWIVEL MEANS 12 WITH A MOP HANDLE

Figure 11:
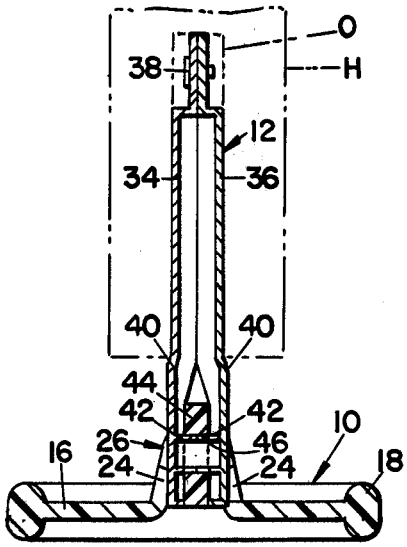
FIG. 11 is a cross-sectional view taken on line 11—11 of FIG. 8.

Following integration of the first and second swivel means, first swivel means 12 is integrated with the lower end of a mop handle H, (see FIGS. 8 and 11), with the half parts 34 and 36 of the first swivel means being inserted in the manner of a friction fit into a provided central opening O which extends upwardly into the mop handle from the lower end thereof. In this manner, the half parts of the first swivel means are held together, wherefore the disc portions 40 thereof are held in engagement with the disc portion 44 of second swivel means 14.

MOP OPERATION

By reason of the construction described above, the mop handle and frame may assume various angular positions relative to each other when the mop is used.

Manipulation by the user of the mop handle causes direct movement of the frame in the desired direction. The pivotal connection permits of certain and dependable variation of the angle or direction at or in which it is desired to operate the mop merely by rotating the handle in one direction or the other and it is such that a wide range of controlled movement is obtainable, regardless of the plane in which the free end of the handle is being moved.

Second swivel means 14 permits substantially 180° swivel movement of the handle in a horizontal plane on either side of the frame, while first swivel means 12 permits 180° swivel movement of the handle in a vertical plane.

I claim:

1. A mop connector comprising, a handle, a frame for releasably carrying a sleeve-like mop member, first swivel means mounted for 180° swivel movement in a vertical plane relative to the frame and releasably attached to the handle, second swivel means mounted for 180° swivel movement about a horizontal axis relative to the frame, the first swivel means comprising a pair of finger-like mirror-image half parts, loosely pivoted together at one end and each having a disc portion at its opposite end, a pin extending inwardly from each disc portion, the second swivel means comprising a flat centrally-apertured disc portion having oppositely projecting cylindrical lugs extending radially outwardly from a central axis thereof, said lugs and apertured disc portion being substantially coplanar, a pair of spaced hollow bosses extending upwardly from the frame receiving the lugs of the second swivel means rotatably therein, pairs of locking fingers on the frame disposed on a plane below the bosses, the lugs being rotatably supported by the locking fingers, the disc portions of the first swivel means embracing the opposed planar faces of the disc portion of the second swivel means with the pins of the first swivel means received loosely in the central aperture of the disc portion of the second swivel means to pivot therein, and with the half-parts of the first swivel means being releasably engaged in the lower end of the handle.

2. A mop connector according to claim 1, wherein the second swivel means is integrated with the frame in the manner of a snap fit, being snapped from below the locking fingers of the frame past the fingers to a position above the fingers.

3. A mop connector according to claim 2, wherein the locking fingers have aligned offset portions and exert a barb-like action on the lugs of the second swivel means, wherefore any downward pressure causes the fingers to hold more securely.

* * * * *